US005414215A

United States Patent [19]

Dunand et al.

[11] Patent Number: 5,414,215

[45] Date of Patent: May 9, 1995

[54] HIGH FREQUENCY ELECTRIC CABLE

[75] Inventors: Michel Dunand, Vigneux-sur-Seine; François Vaille, Corbeil Essonnes, both of France

[73] Assignee: Filotex, Draveil, France

[21] Appl. No.: 9,990

[22] Filed: Jan. 27, 1993

[30] Foreign Application Priority Data

Jan. 28, 1992 [FR] France ..... 92 00869

[51] Int. Cl.[6] ..... H01B 7/00

[52] U.S. Cl. ..... 174/113 R; 174/109

[58] Field of Search ..... 174/113 R, 113 A, 113 C, 174/109, 116, 117 R, 117 M

[56] References Cited

U.S. PATENT DOCUMENTS

| | | | |
|---|---|---|---|
| 2,019,297 | 10/1935 | Faucett | 174/106 SC |
| 3,622,683 | 11/1971 | Roberts et al. | 174/36 |
| 3,649,744 | 3/1972 | Coleman | 174/107 |
| 3,790,694 | 2/1974 | Portinari | 174/23 R |
| 3,843,830 | 10/1974 | Priaroggia et al. | 174/102 D |
| 4,125,739 | 11/1978 | Bow | 174/36 |
| 4,376,920 | 3/1983 | Smith | 333/12 |
| 4,456,785 | 6/1984 | Kushner et al. | 174/105 SC |
| 4,816,614 | 3/1989 | Baigrie et al. | 174/36 |
| 4,900,879 | 2/1990 | Buck et al. | 174/120 R |
| 4,984,357 | 1/1991 | Pan | 29/828 |
| 5,008,489 | 4/1991 | Weeks, Jr. et al. | 174/36 |
| 5,053,582 | 10/1991 | Terauawa et al. | 174/36 |
| 5,089,329 | 2/1992 | de Vrieze et al. | 428/313.5 |
| 5,142,100 | 8/1992 | Vaupotic | 174/24 |
| 5,153,381 | 10/1992 | Ganatra et al. | 174/102 R |
| 5,218,170 | 6/1993 | Ferlier et al. | 174/120 R |
| 5,235,299 | 10/1993 | Vaille et al. | 333/243 |

FOREIGN PATENT DOCUMENTS

| | | |
|---|---|---|
| 902334 | 9/1985 | Belgium . |
| 597957 | 2/1948 | United Kingdom . |

*Primary Examiner*—Leo P. Picard
*Assistant Examiner*—Christopher Horgan
*Attorney, Agent, or Firm*—Sughrue, Mion, Zinn, Macpeak & Seas; Richard C. Turner

[57] ABSTRACT

A high frequency electric cable including at least one inner electrical conductor comprising a twisted strand of conductive wires, wherein a metal tape is taped with overlap around said strand. The overlapping metal tape is used to provide a low linear attenuation and to provide good mechanical strength.

16 Claims, 2 Drawing Sheets

HIGH FREQUENCY ELECTRIC CABLE

The present invention relates to a high frequency electric cable, in particular a coaxial cable or a symmetrical pair cable.

BACKGROUND OF THE INVENTION

High frequency electric cables that take up as little room as possible, i.e. that are capable of withstanding considerable bending stresses and thus considerable curvature, are being sought after more and more at present in order to save space, in particular in aviation, military, and space applications. Such very flexible cables are also required to have mechanical endurance (i.e. good resistance to periodically repeated stresses) and electrical performance that is acceptable given the applications concerned.

In such cables, flexibility problems generally arise with their inner conductors.

In particular, two types of coaxial cable are known at present which satisfy either requirements in terms of flexibility, or else requirements in terms of linear attenuation.

For example, a first type of coaxial cable having low linear attenuation comprises the following disposed coaxially from the inside towards the outside:

a central core constituted by a solid metal conductor called the solid core;

a covering of dielectric material, generally having a relative density that is greater than one;

an outer conductor constituted, for example, by a braid of metal tapes having a braid of circular section wires superposed thereon; and an outer protective sheath of insulating material.

A cable of that type is considered as being satisfactory from the point of view of linear attenuation: at 1 GHz this is generally about 0.12 dB/m to 0.13 dB/m for a cable having a diameter of 10 mm.

In contrast, such a cable has a minimum radius of curvature that is equal to about eight times its outside diameter, and its mechanical endurance is poor. For radii of curvature smaller than the above value, the solid core of the cable is subjected to harmful degradation. Indeed, it is because the material constituting the covering has a relative density greater than one that the central core is supported mechanically and the above-mentioned linear attenuation values are guaranteed so long as the radius of curvature imparted to the cable is equal to eight times its outside diameter.

To increase the flexibility of such cables, proposals have been made to replace the solid central core with twisted-together conductive wires constituting a "divided core" for the cable, and the dielectric material constituting the covering is constituted by a material whose relative density is generally less than one.

Under such circumstances, the minimum radii of curvature that can be achieved are about four to five times the outside diameter of the cable, which constitutes a considerable improvement over the above solid core cables, and mechanical endurance is improved.

Unfortunately, the electrical performance of such cables is not very satisfactory compared with that of solid core cables. In particular, a divided core cable whose central conductor has a core diameter equal to the diameter of the solid core of the corresponding solid core cable (where the term "core diameter" designates the diameter of the circle circumscribing the twisted wires) suffers from linear attenuation that is about 30% greater than that of the solid core cable.

Similar problems are observed in symmetrical pair cables where two insulated internal conductors which may be solid or divided are included within a protective sheath.

Thus, the internal conductors used in various known high frequency electric cables are not capable of simultaneously satisfying requirements in terms of electrical performance (linear attenuation at 1 GHz close to about 0.12 dB/m to 0.13 dB/m for a cable having a diameter of 10 mm), and to mechanical endurance and flexibility requirements (minimum radius of curvature about three to five times the outside diameter of the cable).

OBJECT AND SUMMARY OF THE INVENTION

An object of the present invention is therefore to provide a high frequency electric cable having linear attenuation that is comparable to that of solid core cables and mechanical endurance and a radius of curvature comparable to those of divided core cables.

To this end, the present invention provides a high frequency electric cable including at least one inner electrical conductor comprising a twisted strand of conductive wires, wherein a metal tape is taped with overlap around said strand.

Because of the metal tape, the flexibility of the divided core is conserved while ensuring a better distribution of current density at the surface of the conductor, thereby making it possible to obtain a better distribution of the electromagnetic field inside the high frequency electric cable of the invention; this guarantees linear attenuation along such a cable that is up to 10% better than that of an identical cable possessing a solid core of the same diameter as the twisted wire and tape assembly.

Advantageously, a covering of dielectric material referred to as a "dielectric skin" is disposed around said metal tape in such a manner as to support it.

The dielectric skin may be obtained by extrusion or by taping around the metal tape.

When the skin is extruded around the metal tape, it may be constituted by polytetrafluoroethylene (PTFE), perfluoroalkoxy resin (PFA), fluorinated ethylene-propylene copolymer (FEP), ethylenetetrafluoroethylene (ETFE), polyether-ethercetone (PEEK), polyethylene (PE), or polypropylene (PP).

The dielectric skin may also be constituted by a tape based on PTFE or by a composite tape based on polyimide and PTFE, or on polyimide and FEP, or on polyimide and PFA resin, taped with overlap around the metal tape and having turns that may optionally be bonded together.

Advantageously, the material constituting the dielectric skin is solid so as to provide sufficient mechanical support for the metal tape.

A coaxial cable of the invention may include, disposed coaxially from the inside towards the outside around an inner conductor:

a covering of dielectric material;

an outer conductor; and an outer protective sheath of insulating material.

The dielectric material constituting the covering is preferably expanded and has a density that is less than one-half the density of the same material when not expanded. The cable is thus made more flexible.

A symmetrical pair cable of the invention includes two inner conductors wound helically together or disposed side by side and each surrounded by a covering of dielectric material.

This material is preferably expanded and has a density that is less than one-half the relative of the same material when not expanded.

The two-conductor assembly may be covered with a dielectric sheath. The sheath may also be surrounded by screening.

A symmetrical pair cable constituted in this way may be protected by means of an outer protective sheath of insulating material.

BRIEF DESCRIPTION OF THE DRAWING

Other characteristics and advantages of the present invention are displayed in the following description of an electric cable of the present invention using non-limiting examples.

In the accompanying drawing.

MORE DETAILED DESCRIPTION

Figure 1:
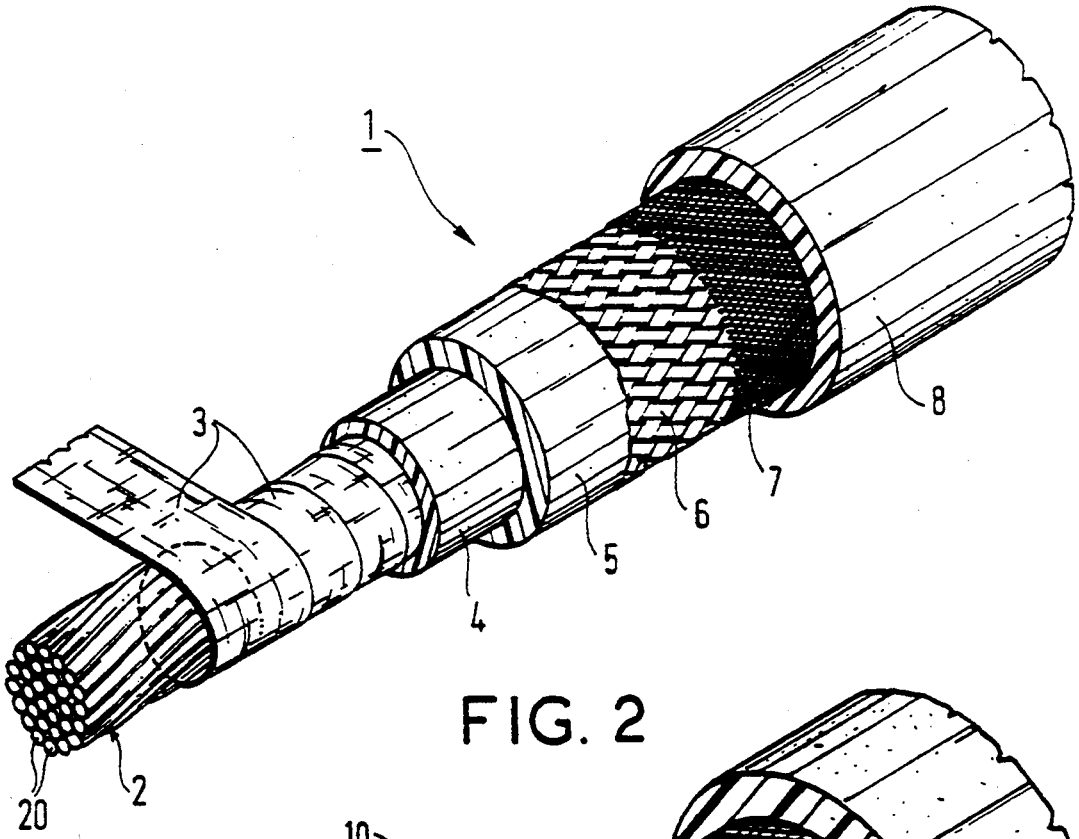
FIG. 1 is an exploded perspective view of a coaxial cable of the invention.

The cable 1 comprises the following disposed coaxially from the inside towards the outside:

a strand 2 of twisted-together metal wires 20, with the core diameter of the strand 2 being 3.1 mm;

a metal tape 3 of silver-plated copper, for example, and taped with overlap around the strand 2, such that the diameter of the assembly is 3.2 mm;

a covering 4, also referred to as "dielectric skin" of solid PTFE having a relative density of about 2 and a thickness of about 0.15 mm;

a covering 5 of expanded PTFE having a relative density of less than 1, and a thickness equal to 2.2 mm;

a braid 6 of metal tapes having a braid 7 of circular section metal wires superimposed thereon, with the diameter of the assembly then being 8.8 mm; and an outer protective sheath 8 of an insulating material having a thickness of 0.5 mm.

The tape 3 imparts electrical properties to the divided core 2 that are little different from those of a solid core while nevertheless ensuring that the cable 1 is as flexible as a cable having a conventional divided core. Thus, the linear attenuation of the cable 1 is about 10% greater than that of a solid core cable which is otherwise identical thereto, and the minimum radius of curvature that can be achieved is three to five times the outside diameter of the cable. The cable of the invention thus makes it possible to combine the advantages of a solid core cable and the advantages of a divided core cable.

In addition, when the cable is used at high frequencies (typically of the order of 100 MHz), a very small thickness of metallization is sufficient for the central conductor because of the skin effect; whereas the divided core of a conventional flexible cable has poor performance at high frequencies because of its irregular outer surface, the cable of the invention makes optimum utilization possible because of the presence of a thin metal tape which is compatible with the skin thickness.

In addition, the dielectric skin 4 ensures that the tape 3 is held mechanically when the cable 1 is subjected to bending stresses, thereby making it possible to avoid the tape 3 opening where it would have done otherwise. An opening in the tape 3 would run the risk of the linear attenuation of the cable having undesirable variations about its nominal value, and the covering 5 which is generally made of a low-density material (for electrical reasons) is not strong enough to provide adequate support. A thin and strong dielectric skin 4 is thus used which is constituted by a dielectric material for holding the tape 3, should that be necessary.

The invention is naturally not limited to the above-described embodiment, and should the need arise it may be applied to high frequency cables of types other than coaxial cables.

For example, the invention is applicable to so-called "symmetrical pair" cables (as contrasted with coaxial cables which are sometimes called "coaxial pair" cables).

Figure 2:
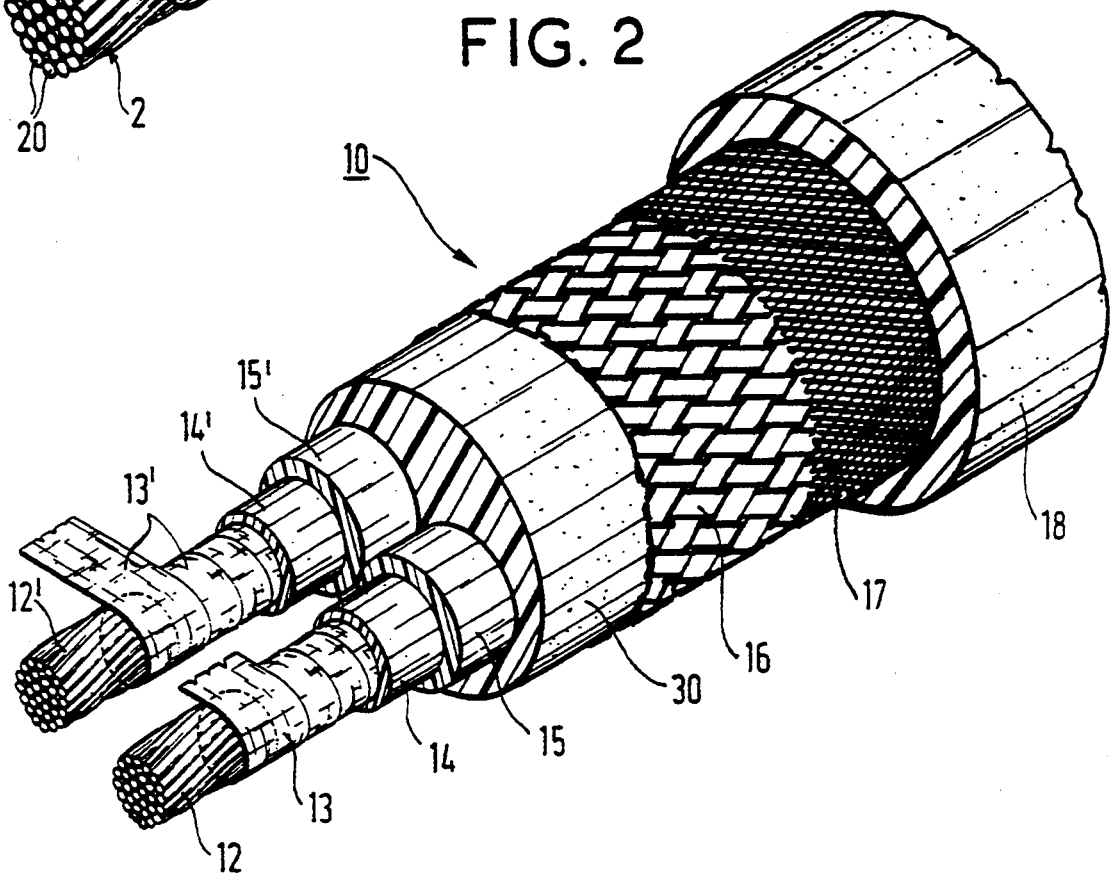
FIG. 2 is an exploded perspective view of a symmetrical pair cable of the invention.
Figure 3:
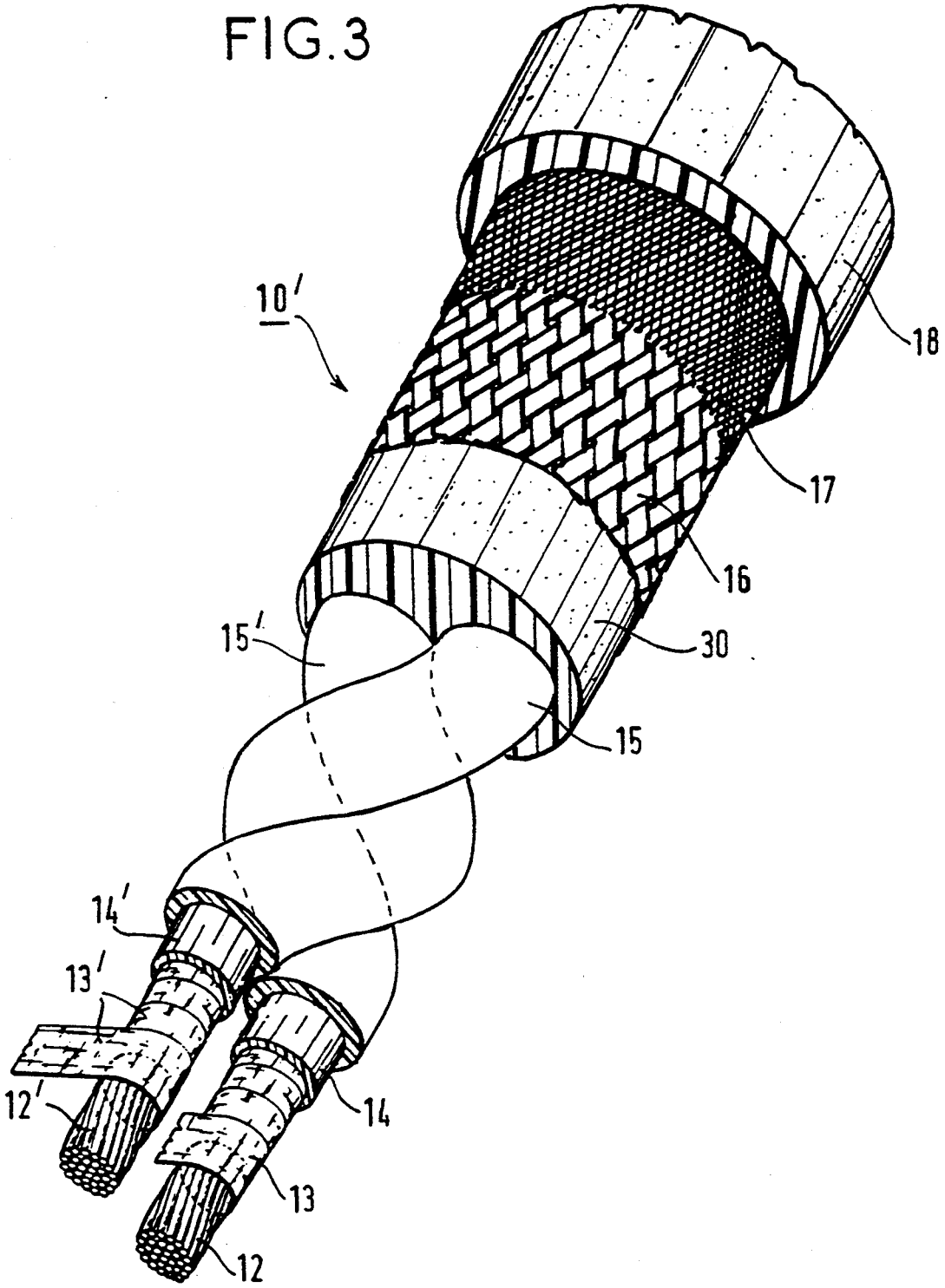
FIG. 3 is an exploded view of another embodiment of a symmetrical pair cable of the invention.

Such cables usually have two divided cores 12 and 12' (FIGS. 2 and 3) each optionally surrounded by a covering of dielectric material 15 and 15' of the same type as the covering 5. The cores are either placed side by side or else they are twisted together helically (see cable 10' in FIG. 3). The assembly may be covered by a dielectric sheath 30, and then by metal screening 16, 17, and it may be protected by an outer protective sheath 18 of insulating material. In accordance with the invention, each of the inner conductors (cores) 12 and 12' of the symmetrical pair cable 10 shown in FIG. 2 or of the cable 10' shown in FIG. 3 is surrounded by a respective metal tape 13, 13' and then optionally by a respective dielectric skin 14, 14' prior to being insulated, if need be, by means of a respective covering 15, 15' of dielectric material.

Whatever the type of cable, the dielectric skin may be obtained by taping or by extrusion, and it may be constituted by a dielectric material other than PTFE. For example, it may be constituted by a tape based on polyimide and on PTFE such as "KAPTON" (the registered trademark). Nevertheless, it must be of sufficient density, i.e. in practice, it must be constituted by a substance that is not expanded (i.e. a solid substance) so as to enable it to provide mechanical support for the metal tape. The dielectric skin is not necessary under all circumstances, and a cable of the invention need not include one.

The dielectric covering may be obtained by taping or by extrusion. It may be constituted by any dielectric material other than expanded PTFE, e.g. expanded PE, providing the density of the material does not prevent the cable achieving the desired endurance and radii of curvature.

When the dielectric covering and/or the dielectric skin are taped, they may be subjected to conventional treatment enabling the various turns of the taping to be bonded together and thus obtaining a uniform covering that has good mechanical strength.

The outer conductor may alternatively be constituted by a single metal braid based on tapes or on wires, or it may be constituted by a metal tape that is wound helically around the dielectric covering.

Finally, any means may be replaced by equivalent means without going beyond the ambit of the invention.

It is claimed:

1. A high frequency electric cable, including at least one inner electrical conductor comprising a twisted strand of conductive wires absent a central passage, and means for decreasing linear attenuation, comprising a metal tape taped with overlap directly around said strand.

2. A cable according to claim 1, wherein a covering of dielectric material is disposed around said metal tape in such manner as to support said metal tape.

3. A cable according to claim 2, wherein said dielectric is obtained by extrusion or by taping around said metal tape.

4. A cable according to claim 2, wherein said dielectric is extruded around said metal tape and is constituted by an insulating material selected from the group consisting of: PTFE, PFA resin, FEP, ETFE, PEEK, PE, and PP.

5. A cable according to claim 2, wherein said dielectric is constituted by a tape based on a material selected from the group consisting of: PTFE, polyimide and PTFE, polyimide and PFA resin, and polyimide and FEP; the tape of said dielectric being taped with overlap around said metal tape.

6. A cable according to claim 5, wherein turns of said tape constituting said dielectric are bounded together.

7. A cable according to claim 2, wherein said material constituting said dielectric is solid.

8. A cable according to claim 1, including, disposed coaxially around an inner conductor from the inside towards the outside:

a covering of dielectric material;

an outer conductor; and an outer protective sheath of insulating material.

9. A cable according to claim 8, wherein said dielectric material constituting said covering is expanded and has a density of less than one-half the density of the same material when not expanded.

10. A cable acccording to claim 1, characterized in that said cable includes two inner conductors.

11. A cable according to claim 10, wherein said inner conductors are helically wound together or disposed side by side.

12. A cable according to claim 10, wherein each of said inner conductors is surrounded by a covering of dielectric material.

13. A cable according to claim 12, wherein said dielectric material constituting said covering is expanded and has a density of less than one-half the density of the same material when not expanded.

14. A cable according to claim 10, wherein the assembly of said two inner conductors is covered by a dielectric sheath.

15. A cable according to claim 14, wherein said dielectric sheath is surrounded by screening.

16. A cable according to claim 10, wherein said cable is protected by an outer protective sheath of insulating material.

* * * * *